US010234254B2

(12) United States Patent
Rastegar

(10) Patent No.: US 10,234,254 B2
(45) Date of Patent: Mar. 19, 2019

(54) MECHANICAL INERTIAL IGNITERS FOR RESERVE BATTERIES AND THE LIKE FOR MUNITIONS

(71) Applicant: Jahangir S Rastegar, Stony Brook, NY (US)

(72) Inventor: Jahangir S Rastegar, Stony Brook, NY (US)

(73) Assignee: OMINTEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 15/130,987

(22) Filed: Apr. 17, 2016

(65) Prior Publication Data

US 2016/0313106 A1 Oct. 27, 2016

Related U.S. Application Data

(60) Provisional application No. 62/152,578, filed on Apr. 24, 2015.

(51) Int. Cl.
*F42C 19/06* (2006.01)
*F42C 1/04* (2006.01)
*F42C 15/24* (2006.01)

(52) U.S. Cl.
CPC ..... *F42C 1/04* (2013.01); *F42C 15/24* (2013.01)

(58) Field of Classification Search
CPC ..... F42C 15/24
See application file for complete search history.

(56) References Cited

U.S. PATENT DOCUMENTS 4,716,830 A * 1/1988 Davis ..... F42C 15/24 102/248
6,240,848 B1 * 6/2001 Specht ..... B60R 22/4652 102/216
2011/0252994 A1 * 10/2011 Murray ..... F42C 7/12 102/215
2012/0132097 A1 * 5/2012 Rastegar ..... F42C 15/24 102/216
2012/0205225 A1 * 8/2012 Rastegar ..... F42C 15/24 200/61.45 R
2013/0284044 A1 * 10/2013 Rastegar ..... F42C 15/24 102/216

* cited by examiner

*Primary Examiner* — Gabriel J. Klein

(57) ABSTRACT

A device including: an impact mass movably restrained relative to a base; and a release mechanism configured to be movable between a restrained position for preventing movement of the impact mass and a released position for permitting movement of the impact mass when the release mechanism is subjected to an acceleration greater than a predetermined magnitude and duration; wherein the release mechanism having a release mass movable when subjected to the acceleration, the movement of the release mass not being influenced by movement of the impact mass.

20 Claims, 13 Drawing Sheets

MECHANICAL INERTIAL IGNITERS FOR RESERVE BATTERIES AND THE LIKE FOR MUNITIONS

CROSS-REFERENCE TO RELATED APPLICATIONS

This application claims the benefit of U.S. Provisional Application No. 62/152,578, filed on Apr. 24, 2015, the entire contents of which is incorporated herein by reference.

BACKGROUND OF THE INVENTION

1. Field of the Invention

The present invention relates generally to mechanical inertial igniters and G-switches, and more particularly to compact, low-volume, reliable and easy to manufacture mechanical inertial igniters, ignition systems for thermal batteries and for G-switches used in munitions for initiation and the like as a result of setback acceleration (shock) or the like.

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand or semi-automatically. Other manufacturing processes have also been recently developed that are more amenable to automation. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low firing setback or the like acceleration (shock) levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

The need to differentiate accidental and other so-called no-fire events from the so-called all-fire event, i.e., the firing setback acceleration (shock) event necessitates the employment of a safety system which is capable of allowing initiation of the inertial igniter only when the inertial igniter is subjected to the impulse level threshold corresponding to or above the minimum all-fire impulse levels. The safety mechanism is preferably provided with a mechanism that provides for a preset (safety) impulse level threshold, which must be reached before the safety mechanism is activated. The safety mechanism can be thought of as a mechanical delay mechanism, which is usually and preferably provided with certain acceleration threshold detection mechanisms, such that after the safety acceleration threshold has been reached and after a certain amount of time delay, a separate initiation system is actuated or released to provide ignition of the inertial igniter pyrotechnics. The inertial igniter pyrotechnic material may have been directly loaded into the ignition mechanism or may be a separately installed percussion primer. An inertial igniter that combines such a safety system with an impact based initiation system and its alternative embodiments are described herein.

Inertia-based igniters must therefore comprise two components so that together they provide the aforementioned mechanical safety (delay mechanism that is activated after a prescribed acceleration threshold has been reached) and to provide the required striking (percussion) action to achieve ignition of the pyrotechnic element(s) of the inertial igniter. The function of the safety system (mechanism) is to hold the striker element fixed to the igniter structure until the inertial igniter is subjected to a high enough acceleration level above the aforementioned acceleration threshold level and with long enough duration, i.e., to a prescribed impulse level threshold after the aforementioned safety acceleration threshold has been reached, corresponding to the firing setback acceleration event. The prescribed safety acceleration threshold provides a minimum acceleration level to ensure that the inertial igniter is safe, i.e., the striker element stays fixed to the inertial igniter structure, when subjected to acceleration levels below the safety acceleration threshold even for long duration. Once the all-fire event, i.e., the minimum (safety threshold) acceleration level and the prescribed impulse level threshold has been reached, the safety system (mechanism) releases the striker element, allowing it to accelerate toward its target. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

A schematic of a cross-section of a conventional thermal battery and inertial igniter assembly is shown in FIG. 1. In thermal battery applications, the inertial igniter 10 (as assembled in a housing) is generally positioned above the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height.

The isometric cross-sectional view of a currently available inertia igniter is shown in FIG. 2, referred to generally with reference numeral 200. The full isometric view of the inertial igniter 200 is shown in FIG. 3. The inertial igniter 200 is constructed with igniter body 201, consisting of a base 202 and at least three posts 203. The base 202 and the at least three posts 203, can be integrally formed as a single piece but may also be constructed as separate pieces and joined together, for example by welding or press fitting or other methods commonly used in the art. The base 202 of the housing can also be provided with at least one opening 204 (with a corresponding opening(s) in the thermal battery—not shown) to allow ignited sparks and fire to exit the inertial igniter and enter into the thermal battery positioned under the inertial igniter 200 upon initiation of the inertial igniter pyrotechnics 215, or percussion cap primer when used in place of the pyrotechnics 215 (not shown). Although illustrated with the opening 204 in the base, the opening (or openings) can alternatively be formed in a side wall or in the striker mass as described in U.S. Pat. No. 8,550,001, the entire contents thereof is incorporated herein by reference.

A striker mass 205 is shown in its locked position in FIG. 2. The striker mass 205 is provided with guides for the posts 203, such as vertical surfaces 206, that are used to engage the corresponding (inner) surfaces of the posts 203 and serve as guides to allow the striker mass 205 to ride down along the length of the posts 203 without rotation with an essentially pure up and down translational motion.

In its illustrated position in FIGS. 2 and 3, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 2. A setback spring 210, which is preferably in compression, is also provided around but close to the posts 203 as shown in FIGS. 2 and 3. In the configuration shown in FIG. 2, the locking balls 207 are prevented from moving away from their aforementioned locking position by the collar 211. The setback spring 210 is preferably a wave spring with rectangular cross-section. The collar 211 is usually provided with partial guide 212 ("pocket"), which are open on the top as indicated by the numeral 213. The guide 212 may be provided only at the location of the locking balls 207 as shown in FIGS. 2 and 3, or may be provided as an internal surface over the entire inner surface of the collar 211 (not shown).

The collar 211 rides up and down on the posts 203 as can be seen in FIGS. 2 and 3, but is biased to stay in its upper most position as shown in FIGS. 2 and 3 by the setback spring 210. The guides 212 are provided with bottom ends 214, so that when the inertial igniter is assembled as shown in FIGS. 2 and 3, the setback spring 210 which is biased (preloaded) to push the collar 211 upward away from the igniter base 201, would "lock" the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In the inertial igniters of the type shown in FIGS. 2 and 3, a one part pyrotechnics compound 215 (such as lead styphnate or other similar compound) is used as shown in FIG. 2. The striker mass 205 is usually provided with a relatively sharp tip 216 and the igniter base surface 202 is provided with a protruding tip 217 which is covered with the pyrotechnics compound 215, such that as the striker mass 205 is released during an all-fire event and is accelerated down (opposite to the arrow 218 illustrated in FIG. 2), impact occurs mostly between the surfaces of the tips 216 and 217, thereby pinching the pyrotechnics compound 215, thereby providing the means to obtain a reliable initiation of the pyrotechnics compound 215. Alternatively, a two-part pyrotechnics compound consisting, for example, one being based on potassium chlorate used in place of the pyrotechnics 215 and the other based on red phosphorous which is positions over a (generally larger) tip 216 of the striker mass 206, may be used. In another alternative design, instead of using the pyrotechnics compound 215, FIG. 2, a percussion cap primer or the like (not shown) is used. In such inertial igniters, the tip 216 of the striker mass 205 is appropriately sized for initiating the percussion cap primer being used.

The basic operation of the inertial igniter 200 shown in FIG. 2 and is as follows. Any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If an acceleration time in the axial direction 218 imparts a sufficient impulse to the collar 211 (i.e., if an acceleration time profile—above the resisting force of the setback spring 210—is greater than a predetermined threshold), it will translate down along the axis of the assembly until the setback locking balls 205 are no longer constrained to engage the striker mass 205 to the posts 203. If the acceleration event is not sufficient to provide this motion (i.e., the acceleration time profile provides less impulse than the aforementioned predetermined threshold), the collar 211 will return to its start (top) position under the force of the setback spring 210.

Assuming that the acceleration time profile was at or above the specified "all-fire" profile, the collar 211 will have translated down past the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 moves downward, causing the tip 216 of the striker mass 205 to strike the pyrotechnic compound 215 on the surface of the protrusion 217 with the requisite energy to initiate ignition.

In the inertial igniter 200 of FIGS. 2 and 3, following ignition of the pyrotechnics compound 215, the generated flames and sparks are designed to exit downward through the opening 204 to initiate the thermal battery below. Alternatively, if the thermal battery is positioned above the inertial igniter 200, the opening 204 can be eliminated and the striker mass could be provided with at least one hole (not shown) to guide the ignition flame and sparks up through the striker mass 205 to allow the pyrotechnic materials (or the like) of a thermal battery (or the like) positioned above the inertial igniter 200 to be initiated.

In the inertial igniter 200 of FIGS. 2 and 3, by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the disclosed inertial igniter 200 can match the all-fire and no-fire impulse level requirements for various applications as well as the safety (delay or dwell action) protection against accidental dropping of the inertial igniter and/or the munitions or the like within which it is assembled.

Briefly, the safety system parameters, i.e., the mass of the collar 211, the spring rate of the setback spring 210 and the dwell stroke (the distance that the collar 210 has to travel downward to release the locking balls 207 and thereby release the striker mass 205) must be tuned to provide the required actuation performance characteristics. Similarly, to provide the requisite impact energy, the mass of the striker 205 and the aforementioned separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

In general, the required aforementioned acceleration time profile threshold for inertial igniter initiation, i.e., the so-called all-fire condition, is described in terms of an acceleration pulse of certain amplitude and duration. For example, the all-fire acceleration pulse may be given as being 1000 G for 15 milliseconds. The no-fire (no-initiation) condition may be indicated similarly with certain acceleration pulse (or half-sine) amplitude and duration. For example, the no-fire condition may be indicated as being an acceleration pulse of 2000 G for 0.5 milliseconds. Other no-fire conditions may include transportation induced vibration, usually around 10 G with a range of frequencies.

It is appreciated by those skilled in the art that when the inertial igniter 200 of FIGS. 2 and 3 is subjected to the aforementioned all-fire acceleration profile threshold, the collar 211 is first caused to be displaced downward under the force caused by the acceleration in the direction of the arrow 218 acting on the inertia (mass) of the collar 211, until the striker mass 205 is released as was described above and accelerated downward to towards the base 202 of the inertial igniter until the tip 216 of the striker mass 205 strikes the pyrotechnic material 215 over the protruding tip 217 and causing it to ignite. It is also appreciated by those skilled in the art that the process of downward travel of the collar 211 takes a certain amount of time, hereinafter indicated as $\Delta t_1$, the amount of which is dependent on the mass of the collar 211 and the aforementioned preloading level of the compressive spring 210 and the distance that it has to travel downward before the balls 207 and thereby the striker mass 205 is released. Similarly, once the striker mass 205 is released, the process of downward travel of the striker mass 205 until its tip 216 strikes the pyrotechnic material 215 over the protruding tip 217 takes a certain amount of time for, hereinafter indicates as $\Delta t_2$, the amount of which is dependent on the level of acceleration in the direction of the arrow 218.

In addition, in recent years new improved chemistries and manufacturing processes have been developed that promise the development of lower cost and higher performance thermal batteries that could be produced in various shapes and sizes, including their small and miniaturized versions. However, inertial igniters are relatively large and not suitable for small and low power thermal batteries, particularly those that are being developed for use in miniaturized fuzing, future smart munitions, and other similar applications. This is in general the case for munitions with relatively low firing setback acceleration, particularly those in which the firing setback acceleration pulse (shock) has relatively short duration.

It is therefore appreciated by those skilled in the art that the duration of the all fire acceleration must at least be the sum of the above two time periods $\Delta t_1$ and $\Delta t_2$, hereinafter indicated as $\Delta t = \Delta t_1 + \Delta t_2$. For example, for the aforementioned case of all-fire (setback) acceleration being 1000 G for 15 milliseconds, the total time $\Delta t$ must be less than the indicated acceleration duration of 15 milliseconds.

In certain cases, due to the small size or geometry of the thermal battery or the like, the height of the inertial igniter that can be used is so small that the striker mass 205 upon its release does not have enough distance to travel downward to gain enough velocity (i.e., enough kinetic energy) before its tip 216 strikes the pyrotechnic material 215 over the protruding tip 217 in order to be able to cause the pyrotechnic material 215 to be reliably ignited.

Inertial igniter all-fire and no-fire requirements generally vary significantly from one application to the other. Therefore it is highly desirable to develop inertial igniters which are provided with the means of independently varying the aforementioned safety acceleration threshold level that has been to be reached and the amount of time delay before which the inertial igniter striker element is released.

It is also highly desirable to provide inertial igniter mechanisms and designs which would minimize the effects of friction and stiction between the parts, which would increase initiation reliability, which would reduce the range of acceleration within which initiation is certain to occur.

It is also highly desirable that the inertial igniter mechanisms and designs would result in devices that can be fabricated inexpensively.

In certain applications, the aforementioned firing setback acceleration duration is very short thereby the said acceleration cannot be relied upon to both actuate the aforementioned safety mechanism and then accelerate the inertial igniter striker element to the required speed (energy) to achieve pyrotechnic initiation.

SUMMARY OF THE INVENTION

A need therefore exists for inertial igniters that can be used to initiate thermal batteries or the like in munitions or the like when the height available in munitions is too small as is described above for inertial igniters of the type shown in FIGS. 2 and 3 to be used.

A need also exists for inertial igniter mechanisms that would provide the means of independently varying the safety acceleration threshold level of the inertial igniter that has to be reached and the amount of time delay before which the inertial igniter striker element is released to ignite the device pyrotechnics.

A need also exists for inertial igniter mechanisms and designs which would minimize the effects of friction and stiction between the parts.

A need also exists for inertial igniter mechanisms and designs that would significantly increase operational reliability of the inertial igniter.

A need also exists for inertial igniter mechanisms and designs that would reduce the range of setback or the like acceleration level within which initiation certainty may occur.

A need also exists for inertial igniter mechanisms and designs that would make the inertial igniter manufactured at lower cost by reducing the number of parts and/or by reducing the complexity and manufacturing cost of the inertial igniter parts and their quality control and assembly costs.

A need also exists for inertial igniters that can be used in applications in which the setback acceleration level is relatively low and/or the setback acceleration duration is relatively short.

Such inertial igniters must be safe and do not initiate when subjected no-fire conditions. In general, such inertial igniters are also required to withstand the harsh firing environment, while being able to be designed to ignite at specified acceleration levels when subjected to such accelerations for a specified amount of time to match the firing acceleration experienced. Very high reliability is also of much concern. The inertial igniters must also usually have a shelf life of up to 20 years and could generally be stored at temperatures of sometimes in the range of −65 to 165 degrees F. This requirement is usually satisfied best if the igniter pyrotechnic is in a sealed compartment. The inertial igniters must also consider the manufacturing costs and simplicity in design to make them cost effective for munitions applications.

To ensure safety and reliability, inertial igniters should not initiate during acceleration events which may occur during manufacture, assembly, handling, transport, accidental drops, etc. Additionally, once under the influence of an acceleration profile particular to the firing of ordinance from a gun, the device should initiate with high reliability. It is also conceivable that the igniter will experience incidental low but long-duration accelerations, whether accidental or as part of normal handling, which must be guarded against initiation.

Those skilled in the art will appreciate that the inertial igniters disclosed herein may provide one or more of the following advantages over prior art inertial igniters:

- provide small height inertial igniters that can be initiated when subjected to short duration firing setback acceleration (shock);
- can be designed to provide small inertial igniters that can be initiated when subjected to relatively low firing setback acceleration (shock);
- can be designed with independently adjustable all-fire (safety) and no-fire acceleration profiles;
- can be designed such that its moving parts operate with minimal friction and stiction so that the initiation can be achieved reliably within a relatively small range of acceleration range;
- provide inertial igniters that are significantly shorter than currently available inertial igniters for thermal batteries or the like;
- provide inertia igniters that could be constructed to guide the pyrotechnic flame essentially downward (in the direction opposite to the direction of the firing acceleration—usually for mounting on the top of the thermal battery as shown in FIG. 1), or essentially upward (in the direction opposite of the firing acceleration—usually for mounting at the bottom of the thermal battery);

In view of such objects, inertial igniters and ignition systems for use with thermal batteries or the like upon subjection to firing setback acceleration, in particular low friction and stiction with independently adjustable no-fire (safety) acceleration threshold and all-fire acceleration activation levels and those that can be fabricated at relatively low cost are provided. Provided are also inertial igniters that are very low height for small thermal batteries. Still yet provided are G-switches based on the disclosed inertial igniters.

Accordingly, a device is provided. The device comprising: an impact mass movably restrained relative to a base; and a release mechanism configured to be movable between a restrained position for preventing movement of the impact mass and a released position for permitting movement of the impact mass when the release mechanism is subjected to an acceleration greater than a predetermined magnitude and duration; wherein the release mechanism having a release mass movable when subjected to the acceleration, the movement of the release mass not being influenced by movement of the impact mass.

The release mass can be separated from the impact mass in a lateral direction relative to a direction of the acceleration.

The impact mass can be rotatably movable relative to the base.

The device can further comprise a flame producing means for outputting a flame upon movement of the impact mass. The flame producing means can comprise: a first protrusion provided to protrude from a surface of the impact mass; a second protrusion provided to protrude from the base, the second protrusion being positioned such that movement of the impact mass causes contact between the first and second protrusions; a pyrotechnic provided proximate to one of the first and second protrusions such that the contact between the first and second protrusions ignites the pyrotechnic; and an opening in the base for outputting the flame from the base.

The impact means can include a biasing member for biasing the impact mass in a direction opposite to the direction of the acceleration.

The device can further comprise a circuit means for one of opening or closing an electrical circuit upon movement of the impact mass. The circuit means can comprise: an electrically conductive member provided to a surface of the impact mass; and first and second electrical contacts, electrically isolated from each other, provided to the base, the first and second electrical contacts being positioned such that movement of the impact mass causes the electrically conductive member to contact and close the electrical circuit between the first and second electrical contacts. The circuit means can comprise: an electrically non-conductive member provided to protrude from a surface of the impact mass; and first and second electrical contacts, electrically connected to each other, provided to the base, the first and second electrical contacts being biased in an electrically closed position and movable to an electrically open position, the first and second electrical contacts being positioned such that movement of the impact mass causes the electrically non-conductive member to move the first and second electrical contacts to the electrically open position.

The release mechanism can comprise: a shaft having one end engaged with a portion of the impact mass and an other end engaged with the release mass, the shaft being movable to the released position upon movement of the release mass when the release mass is subjected to the acceleration; and a shaft biasing element for biasing the shaft into the released position when the release mass moves and is no longer engaged with the other end of the shaft. The device can further comprise a release mass biasing element for biasing the release mass into a position of engagement with the other end of the shaft. The release mass can move in translation. The release mass can move in rotation. The device can further comprise a housing including the base.

Also provided is a method for moving an impact mass upon the impact mass experiencing an acceleration greater than a predetermined magnitude and duration. The method comprising: movably restraining the impact mass relative to a base; moving a release mechanism between a restrained position for preventing movement of the impact mass and a released position for permitting movement of the impact mass when the release mechanism is subjected to the acceleration; and configuring the release mechanism to have a release mass movable when subjected to the acceleration, wherein the movement of the release mass is not influenced by movement of the impact mass.

The method can further comprise separating the release mass from the impact mass in a lateral direction relative to a direction of the acceleration.

The method can further comprise outputting a flame upon movement of the impact mass.

The method can further comprise one of opening or closing an electrical circuit upon movement of the impact mass.

The release mass can move in translation.

The release mass can move in rotation.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 4:
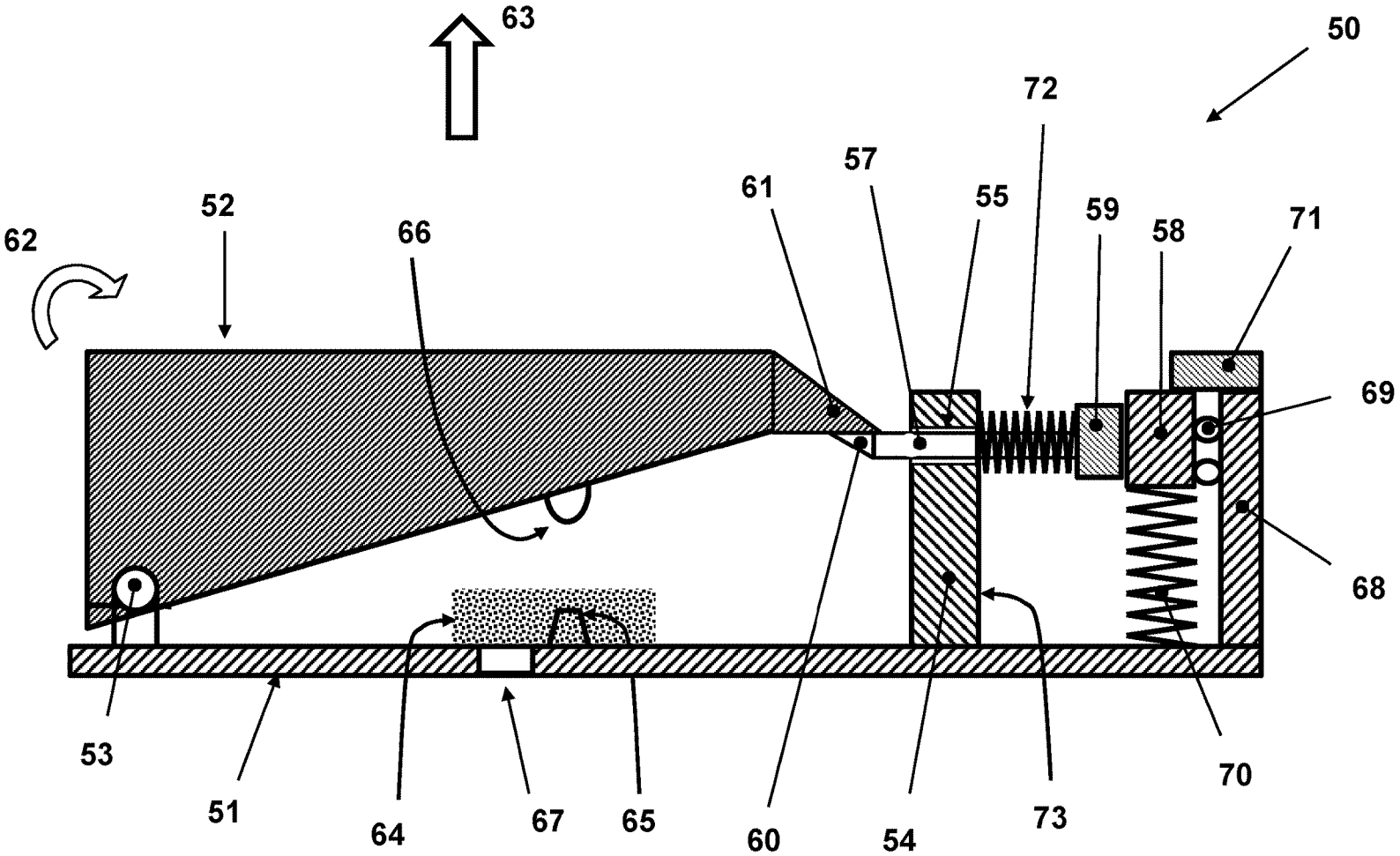
FIG. 4 illustrates a schematic of a cross-section of the first inertial igniter embodiment of the present invention.

A schematic of a cross-sectional view of a first embodiment 50 of an inertia igniter is shown in FIG. 4. The inertial igniter 50 consists of a base element 51, which in a thermal battery construction shown in FIG. 1 can be positioned in a housing (10 in FIG. 1) with the base element 51 positioned on the top of the thermal battery cap (19 in FIG. 1). However, the base element 51 can also be a portion of the housing. A striker mass 52 (alternatively referred to as a impact mass) of the inertial igniter 50 is attached to the base element 51 via a rotary joint 53. Although shown as being rotatable, the striker mass 52 can also be movable in translation, such as in the direction opposite to the direction of arrow 63. In such configuration, the striker mass can be on one or more rails for constraining the translation along a direction of the one or more rails and the one or more rails can include bearings or other low friction means, such as treated low friction surfaces between the one or more rails and corresponding bores in the striker mass 52.

A post 54, which is fixed to the base element 51 is provided with a hole 55. A shaft 57 is positioned in the hole 55 and is movable within the hole from a position engaging the striker mass 52 to a position not engaging the striker mass 52. Attached to the shaft 57 is the head 59 which in the pre-initiation configuration shown in FIG. 4 rests against a sliding member 58 (alternatively referred to as a release mass). A compressively preloaded compressive spring 72 is also provided between the head 59 of the shaft 57 and a surface 73 of the post 54 to keep the head 59 in contact with the sliding member 58.

In the configuration of FIG. 4, the (up-down) sliding member 58 is shown to block the movement of the shaft 57 and head 59 member away from engagement with the striker mass 52 (the release mechanism is engaged with the mass 52 in a restrained position). Thereby in the configuration of FIG. 4, an end 60 of the shaft 57 is positioned below a tip 61 of the striker mass 52, preventing the striker mass 52 from rotating clockwise in the direction of the arrow 62 as shown in FIG. 4.

The sliding member 58 is free to slide down against a member 68, if necessary via rolling elements 69. However, sliding contact between the member 68 and sliding member 58 may also be utilized, particularly if the contacting surfaces are low friction surfaces. However, it will be appreciated by those skilled in the art that the rolling elements 69 would provide a means of reducing sliding friction between the sliding member 58 and the member 68 and minimize the possibility of stiction between the moving surfaces. As a result, a level of force needed to move the sliding member down become highly predictable, which in turn makes the level of acceleration needed to release the inertial ignite striker mass 52 more predictable as is described later. Similar roller elements (not shown) may also be positioned between the contacting surfaces of the sliding member 58 and the head 59 of the shaft 57. The rolling elements 69 can be housed in retaining cavities (not shown) in the sliding member 58 or similarly held onto the sliding member 58 via a commonly used cage element (not shown).

The member 68 is fixed to the base element 51. A spring element 70 resists downward motion of the sliding member 58, and can be preloaded in compression so that if a downward force that is less than the compressive preload is applied to the sliding member 58, the applied force would not cause the sliding element 58 to move downwards. A stop 71 fixed to the member 68, is provided to allow the spring element 70 to be preloaded in compression by preventing the sliding member 58 from moving further up (in the direction of arrow 68) from the configuration shown in FIG. 4.

During the firing, the inertial igniter 50 is considered to be subjected to setback acceleration in the direction of the arrow 63. The acceleration in the direction of the arrow 63 acts on the inertia of the sliding element 58 and generates a downward force that tends to slide the sliding element 58 downwards (opposite to the direction of acceleration). The compression preloading of the spring element 70 is generally selected such that with the no-fire acceleration levels, the inertia force acting on the sliding element 58 would not overcome (or at most be equal to) the preloading force of the spring element 70. As a result, the inertial igniter 50 is ensured to satisfy its prescribed no-fire requirement. Alternatively, and particularly when the peak no-fire acceleration level is higher than the peak all-fire (setback) acceleration levels but is very short duration as compared to the duration of the all-fire acceleration, then the time that it takes for the sliding element 58 to move down enough to clear the head 59 of the shaft 57 is designed to be less than the duration of the no-fire acceleration events.

Now if the acceleration level in the direction of the arrow 63 is high enough, then the aforementioned inertia force acting on the sliding element 58 will overcome the preloading force of the spring element 70, and will begin to travel downward. If the acceleration level is applied over a long enough period of time (duration) as well, i.e., if the all-fire condition is satisfied and the sliding element 58 will have enough time to travel down far enough and clears the head 59 of the shaft 57, then the compressively preloaded spring 72 would push the head 59 and the shaft 57 away from the striker mass 52, thereby disengaging the tip 60 of the shaft 57 from the tip 61 of the striker mass 52. As a result, the striker mass 52 is released and is allowed to be accelerated in the clockwise rotation as indicated by the arrow 62 (the release mechanism takes a release portion where it is no longer engaged with the mass 52). As a result, for a properly designed inertial igniter 50 (i.e., by selecting a proper mass and moment of inertial for the striker mass 52 and the range of clockwise rotation for the striker mass 52 so that it would gain enough energy), the striker mass 52 will gain enough kinetic energy to initiate the pyrotechnic material 64 between the pinching points provided by the protrusions 65 and 66 on the base element 51 and the bottom surface of the striker mass 52, respectively, as shown in FIG. 4. The ignition flame and sparks can then travel down through the opening 67 provided in the base element 51. When assembled in a thermal battery similar to the thermal battery 16 of FIG. 1, the inertial igniter is mounted in the housing 10 such that the opening 67 is lined up with the opening 12 into the thermal battery 11 to activate the battery by igniting its heat pallets.

It will be appreciated by those skilled in the art that the duration of the all-fire acceleration level can also be important for the operation of the inertial igniter 50 by ensuring that the all-fire acceleration level is available long enough to accelerate the striker mass 52 towards the base element 51 to gain enough energy to initiate the pyrotechnic material 64 as described above by the pinching action between the protruding elements 65 and 66.

Figure 1:
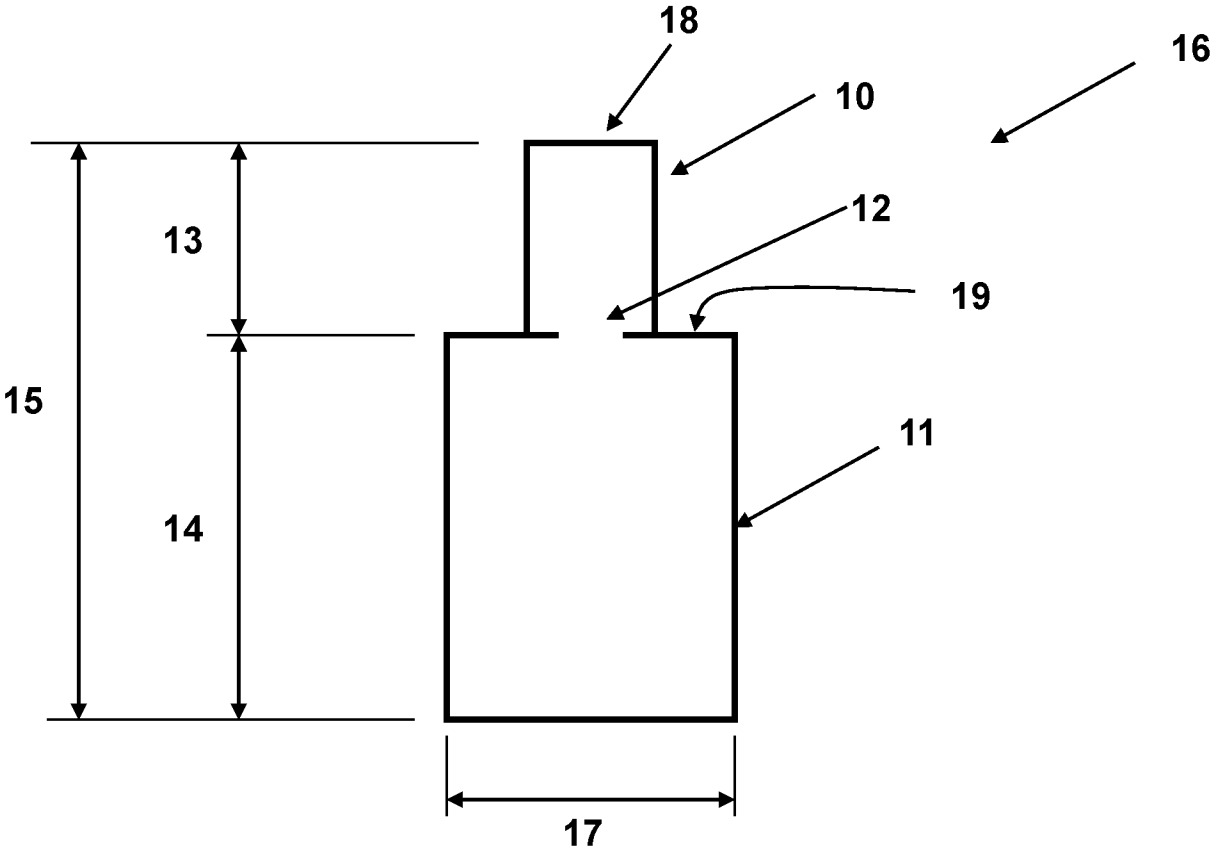
Figure 1 (PRIOR ART)
FIG. 1 illustrates a schematic of a cross-section of a thermal battery and inertial igniter assembly of the prior art.

It will be appreciated by those skilled in the art that when the inertial igniter 50 (FIG. 4) is assembled inside the housing 10 of the thermal battery assembly 16 of FIG. 1, a cap 18 (or a separate internal cap—not shown) is commonly used to secure the inertial igniter 50 inside the housing 10. In such assemblies, the stop element 71 is no longer functionally necessary since the sliding element 58 can be prevented from being pushed upward by the force of the spring element 70 and releasing the striker mass 52 by an internal surface/component of the cap. It will be, however, appreciated by those skilled in the art that by providing the stop element 71, particularly if it is extended to at least partially over the top surface of the striker mass 52, then the storage of the inertial igniter 50 and the process of assembling it into the housing 10 is significantly simplified since one does not have to provide secondary means to keep the spring element 70 from pushing the sliding element 58 further up and thereby clearing the head 59 of the shaft 57 and releasing the striker mass 52.

Figure 2:
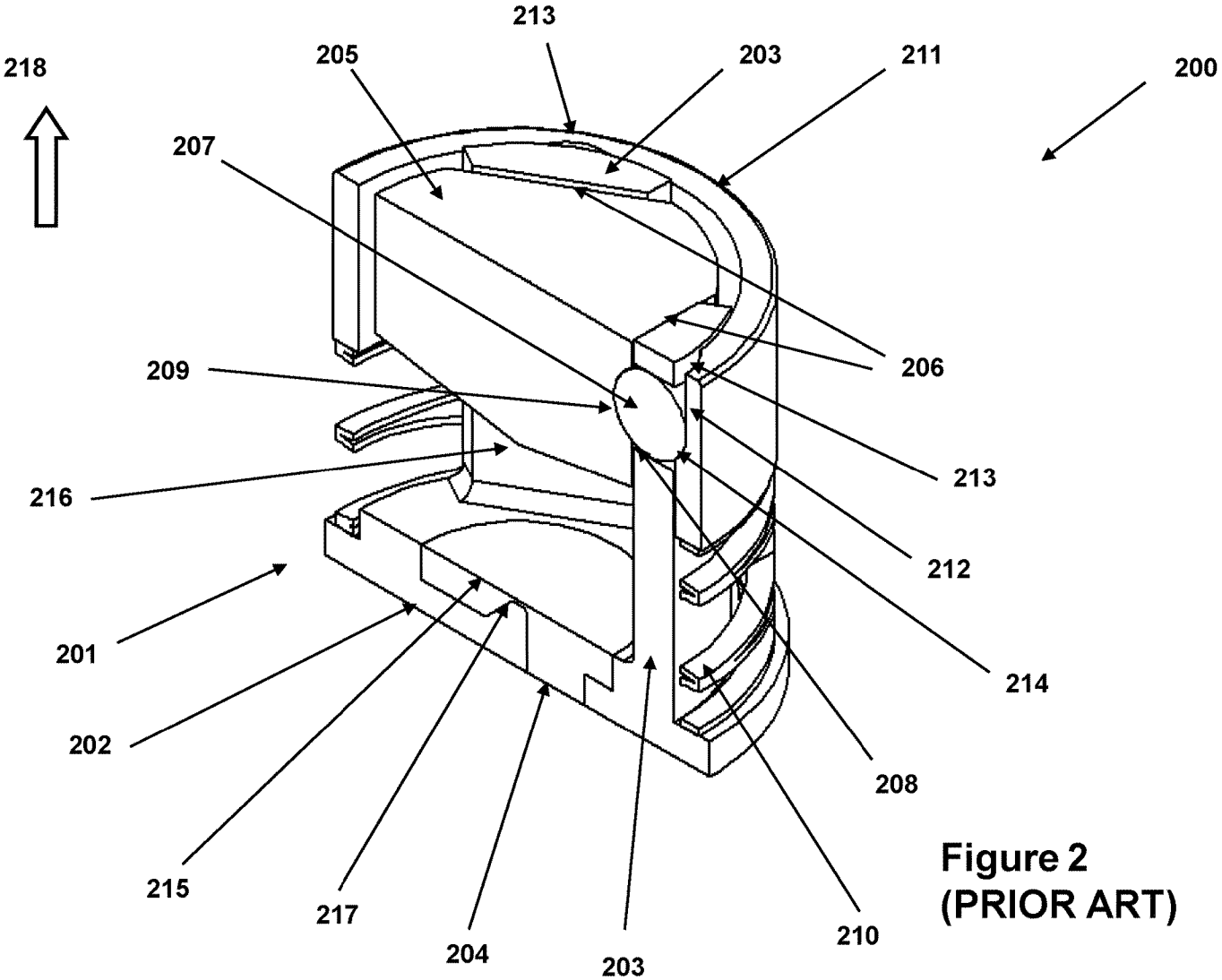
Figure 2 (PRIOR ART)
FIG. 2 illustrates an isometric cut away view of an inertial igniter assembly of the prior art.
Figure 3:
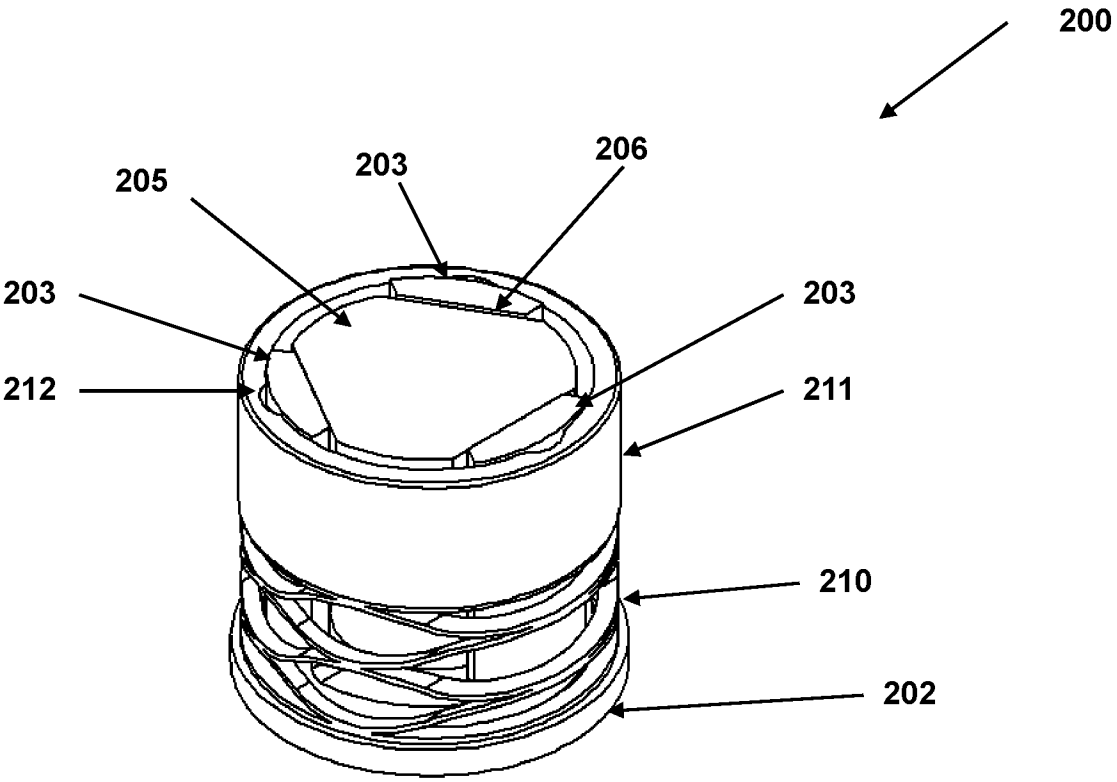
Figure 3 (PRIOR ART)
FIG. 3 illustrates a full isometric view of the prior art inertial igniter of FIG. 2.

It will be appreciated by those skilled in the art that in the inertial igniter embodiment 50 of FIG. 4, and in contrast to the prior art of FIGS. 2 and 3, the downward force due to the acceleration in the direction of the arrow 63 acting on the mass (inertia) of the striker mass 52 does not increase the level of force that is required for the slider element 58 to be moved downward to release the striker mass as was previously described. It will also be appreciated by those skilled in the art that in the inertial igniter of the prior art shown in FIGS. 2 and 3, as the inertial igniter 200 is accelerated similarly in the direction of the arrow 218, the generated force due to the mass of the striker element 205 would cause the locking balls 207 to be forced outward against the surfaces of the pockets 212 of the collar 211, thereby increasing the resistance of the collar to downward motion, thereby to the release of the striker element 205. This very important feature of the inertial igniter embodiment 50 of FIG. 4 ensures the consistency with which the igniter striker mass 52 can be released within a very narrow range of acceleration in the direction of the arrow 63, i.e., for the case of munitions, within a narrow range of firing setback or the like acceleration event.

It will also be appreciated by those skilled in the art that by providing a preloaded compressive force level in the spring 72 that is greater than the maximum friction and stiction forces between the tip 61 of the striker mass 52 and the tip 60 of the shaft 57 as well as between the shaft 57 and the hole 55 in the post 54, then once the sliding element 58 has cleared the head 59 of the shaft 57, then the tip 60 of the shaft 57 is ensured to be pulled away from the top 61 of the striker mass 52 to initiate its accelerated clockwise rotation in the direction of the arrow 62, thereby initiating the pyrotechnic material 64 as was previously described.

In the embodiment of FIG. 4, the sliding element 58 and the spring element 70 of the release mechanism of the inertial igniter 50 may be configured in numerous ways, e.g., the sliding element 58 may be replaced with a rotating member (which may further reduce friction and stiction in the release mechanism) and the spring member 70 may be integral with the resulting rotating member, i.e., as a flexible beam element with living joints with the inertia of the beam acting as the mass element of the resulting slider element.

It will be appreciated by those skilled in the art that the hole 55 and the cross-section of the mating shaft 57 do not have to be circular. For example, the designer may choose to use non-circular shapes instead to provide the means of preventing and/or minimizing the rotation of the shaft 57 about its long axis. For example, the designer may choose a trapezoidal mating shape or a shape close to or similar to a trapezoidal shape so that during assembly the two parts could be mated only in the correct orientation and thereby eliminate assembly mistakes and the need for post assembly inspection.

In certain applications, the all-fire setback acceleration level is either not high enough to impart enough kinetic energy to the striker mass 52 or its duration is not long enough to allow the striker mass be released by the downward motion of the sliding element 58 and the clockwise rotation of the striker mass in the direction of the arrow 62. As a result, the striker mass 52 is released as a result of setback firing acceleration or other prescribed acceleration events, but the striker mass is not capable to reliably ignite the pyrotechnic material 64 by the resulting impact (pinching) between the protruding elements 65 and 66. In such applications, additional kinetic energy may be provided by the potential energy stored in appropriately positioned preloaded spring element(s). An example of such an inertial igniter is shown in the schematic of the cross-sectional view of the inertial igniter embodiment 80 of FIG. 5.

Figure 5:
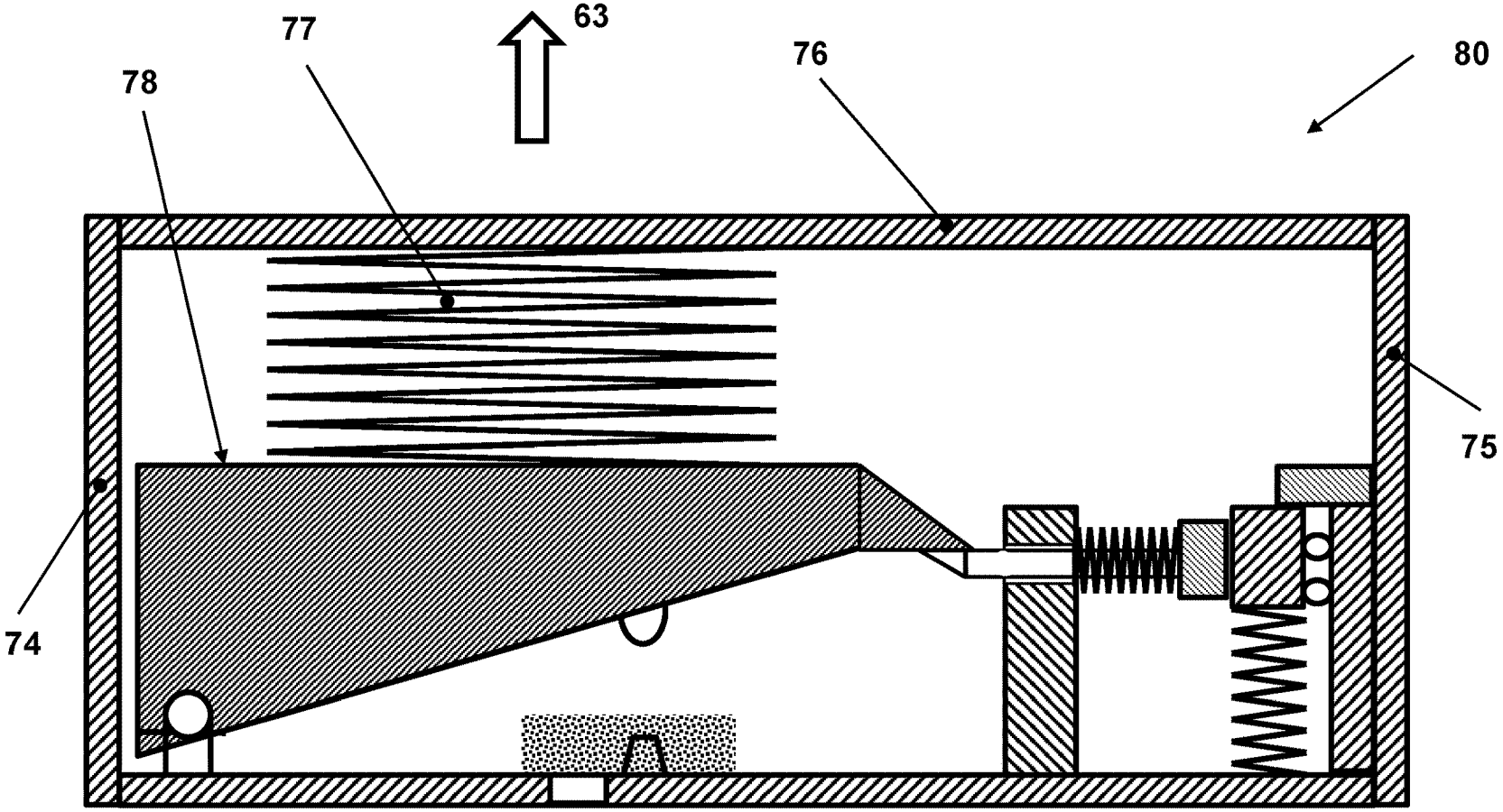
FIG. 5 illustrates a schematic of a cross-section of the second inertial igniter embodiment of the present invention.

All components of the inertial igniter embodiment 80 of FIG. 5 are identical to those of the embodiment 50 of FIG. 4, except for the following added components. The same components illustrated in FIGS. 4 and 5 are similarly numbered, however, such reference numerals are omitted in FIG. 5 for the sake of clarity. In the embodiment 80, the embodiment 50 of FIG. 4 is provided to add sides 74 and 75 and a top cover 76 to the base element 51 to form a housing. A compressively preloaded spring 77 is also positioned between the top cover 76 and the top surface 78 of the striker mass 52. Then, as the inertial igniter 80 is subjected to the firing setback acceleration or the like in the direction of the arrow 63, and if the aforementioned prescribed all-fire conditions have been satisfied, then following the release of the striker mass 52 as was previously described for the embodiment 50 of FIG. 4, the continuing acceleration in the direction of the arrow 63 and/or the force exerted by the compressively preloaded spring 77 will rotationally accelerate the striker mass 52 in the clockwise direction as shown by the arrow 62 in FIG. 4, imparting enough kinetic energy to the striker mass 52 so that as the resulting impact (pinching) between the protruding elements 65 and 66 would cause the pyrotechnic material 64 to ignite.

Figure 6A:
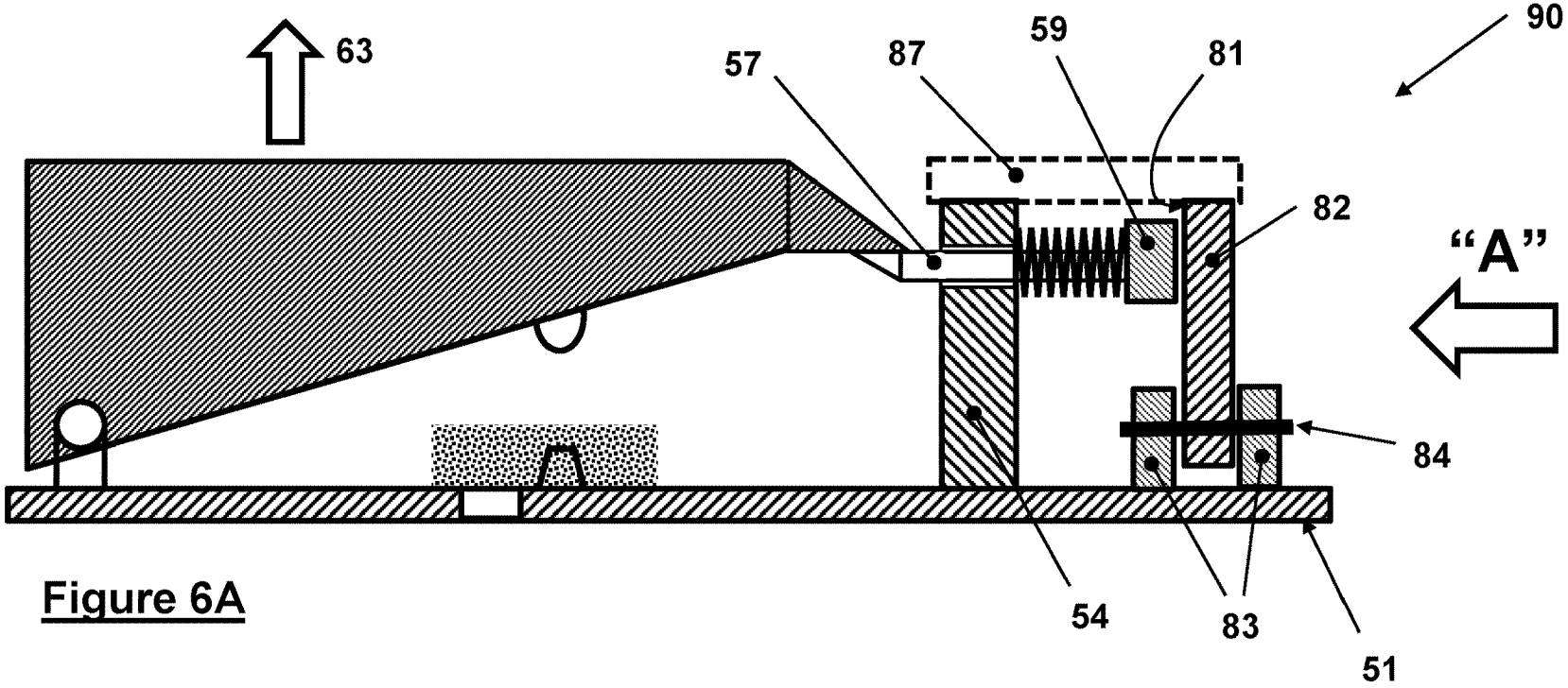
FIG. 6A illustrates a schematic of a cross-section of the third inertial igniter embodiment of the present invention.

A third embodiment 90 of the inertial igniter of the present invention is shown in the cross-sectional view of FIG. 6A. All components of the inertial igniter embodiment 90 of FIG. 6A are identical to those of the embodiment 50 of FIG. 4, except for the slider element 58 based striker mass release mechanism. In the embodiment 90 of FIG. 6A, the sliding element 58 is replaced by a rotating mechanism to reduce device complexity and the sliding friction forces. In the embodiment 90, the motion of the head 59 of the shaft 57 away from the striker mass engagement, FIGS. 4 and 6A, is prevented by the surface 81, the opposite side of the end 85 of the link 82 shown in the view "A" of FIG. 6B. The link 82 is attached to the inertial igniter base 51 via the rotary joint composed of the supports 83 and the rotary joint pin 84 as shown in FIG. 6A and the view "A" shown in FIG. 6B. The link 82 is also provided with a preloaded spring 86 which is biased to keep the link 82 against the stop (for example stop 87, which is fixed to the post 54, FIG. 6A, or the stop 88, which is fixed to the rotary joint support 83, FIG. 6B). The link stop (elements 87 or 88) is positioned such that in pre-initiation configuration, the biasing preloaded spring 86 would position the end 85 of the link 82 against the head 59 of the shaft 57.

Figure 6B:
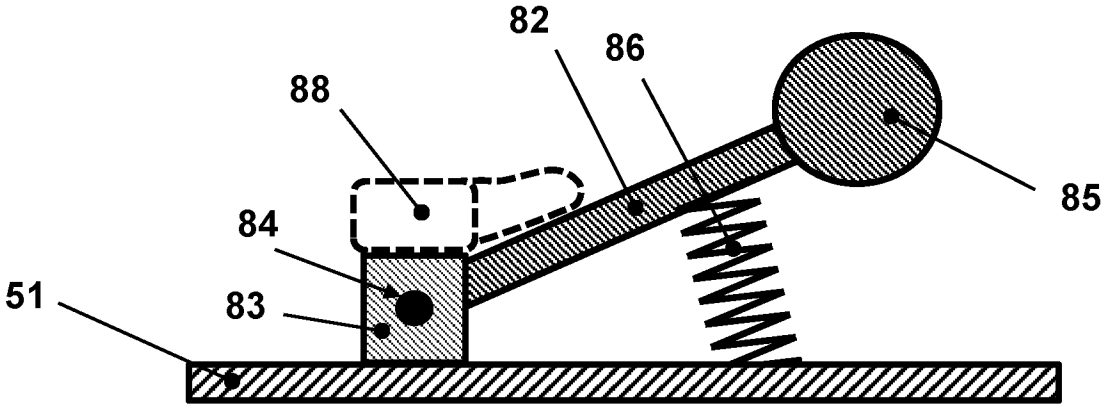
FIG. 6B illustrates the view "A" of the release mechanism of the embodiment of FIG. 6A.

Then when the inertial igniter is accelerated in the direction of the arrow 63, the force resulting by the action of the acceleration on the mass of the link 82 and its end 85 will tend to rotate the link 82 in the clockwise direction as seen in the view "A" of FIG. 6B. If the level of acceleration in the direction of the arrow 63 is high enough to overcome the preloaded force of the spring 86, then the link 82 will begin to rotate in the clockwise direction as seen in FIG. 6B. If the duration of the above acceleration is long enough, then the link 82 will rotate in the clockwise direction enough for the surface 81 of the end 85 of the link 82 to clear the head 59 of the shaft 57, thereby allowing the shaft 57 to move away from engagement with the striker mass 52, thereby allowing the striker mass to accelerate downward as was described for the embodiment of FIG. 4 and cause the pyrotechnic material 64 of the inertial igniter to be ignited.

It will be appreciated by those skilled in the art that the link 82 may be fixedly attached to the base plate 51 and be provided with a rotary (flexural) living joint to serve the same purposed as is described above for the link 82 and its end 85. In such an arrangement, the flexibility of the said flexural living joint may be used to serve the purpose of the spring 86. In which case the aforementioned preloading of the spring 86 may also be achieved by designing the flexural element such that in normal conditions the link 82 positions the end 85 passed the head 59 of the shaft 57. Then the prescribed preloading level is achieved by rotating the link in the clockwise direction and bringing it to stop against the provided stop element (elements 87 or 88 in FIG. 6A).

In the embodiments 50, 80 and 90 of FIGS. 4, 5 and 6A, respectively, pyrotechnic materials 64 are shown to be used for ignition upon inertial igniter initiation through the impact (pinching) between the protruding elements 65 and 66. It is, however, appreciated by those skilled in the art that instead of the pyrotechnic material 64, which has to be applied individually to the inertial igniter 50 base 51 over the protruding element 65, one may instead install commonly used percussion caps such as those commonly used in gun bullets or the like in a provided cavity (not shown but usually specified by the percussion cap manufacturer) in the base 51 (to be initiated by the impact of the appropriately shaped protruding element 66). The advantage of using the pyrotechnic material 64 is that they can be designed to initiate at impact energies that are significantly lower than that of percussion primers, however at significantly higher per unit cost. Percussion primers are however mass produced at high volumes and are therefore significantly lower in cost and easy to install. For purposes of this disclosure and the appended claims, "pyrotechnic material" will include the use of the pyrotechnic materials as discussed above with regard to FIGS. 4, 5 and 6A as well as the alternative percussion caps discussed immediately above.

In the above embodiments, the disclosed devices are intended to actuate, i.e., release their striker mass 52 in response to an all-fire acceleration level to accelerate downwards to impact the provided pyrotechnics materials causing them to ignite. The same mechanisms used for the release of the striker mass due to an all-fire acceleration can be used to provide the means of opening or closing an electrical circuit, i.e., act as a so-called G-switch, that is actuated only if it is subjected to an all-fire acceleration profile, while staying inactive during all no-fire conditions, even if the acceleration level is higher than the all-fire acceleration level but significantly shorter in duration. As a result, this novel G-switch device would satisfy all no-fire (safety) requirements of the device in which it is used while activating in the prescribed all-fire condition.

Figure 7:
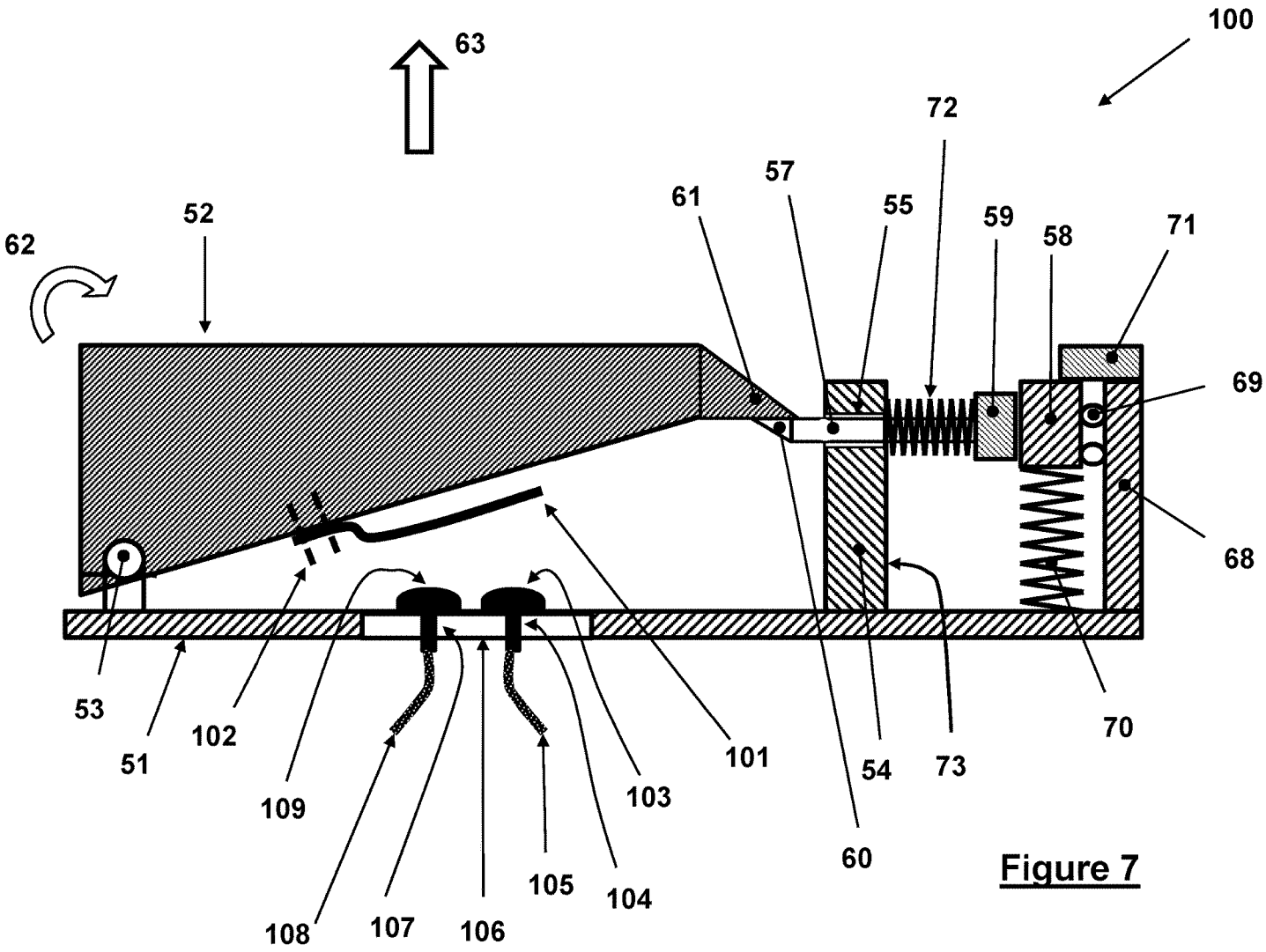
FIG. 7 illustrates a schematic of a cross section of a normally open g-switch embodiment corresponding to the first inertial igniter embodiment of FIG. 4.
Figure 8:
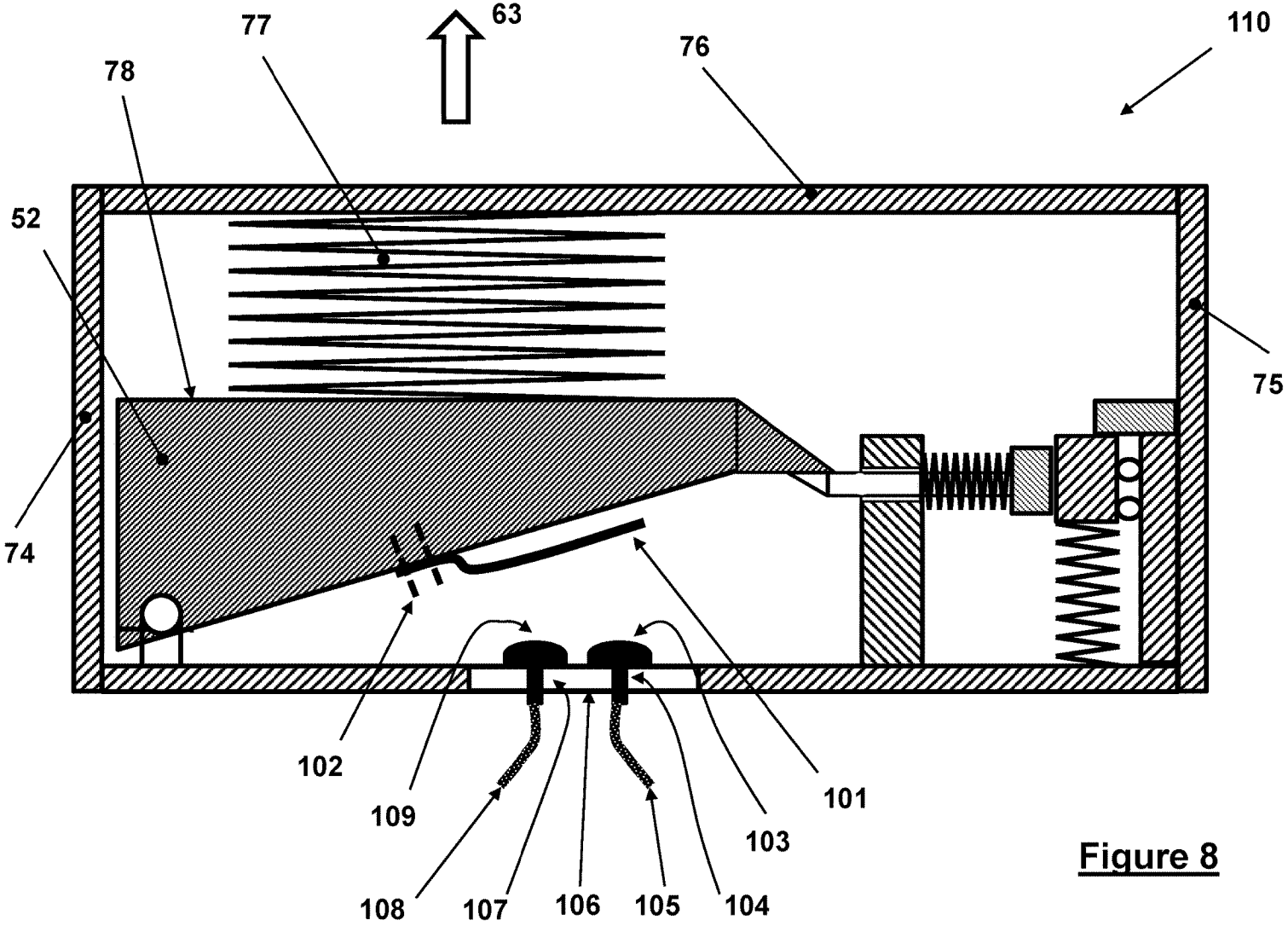
FIG. 8 illustrates a schematic of a cross section of a normally open g-switch embodiment corresponding to the second inertial igniter embodiment of FIG. 5.
Figure 9:
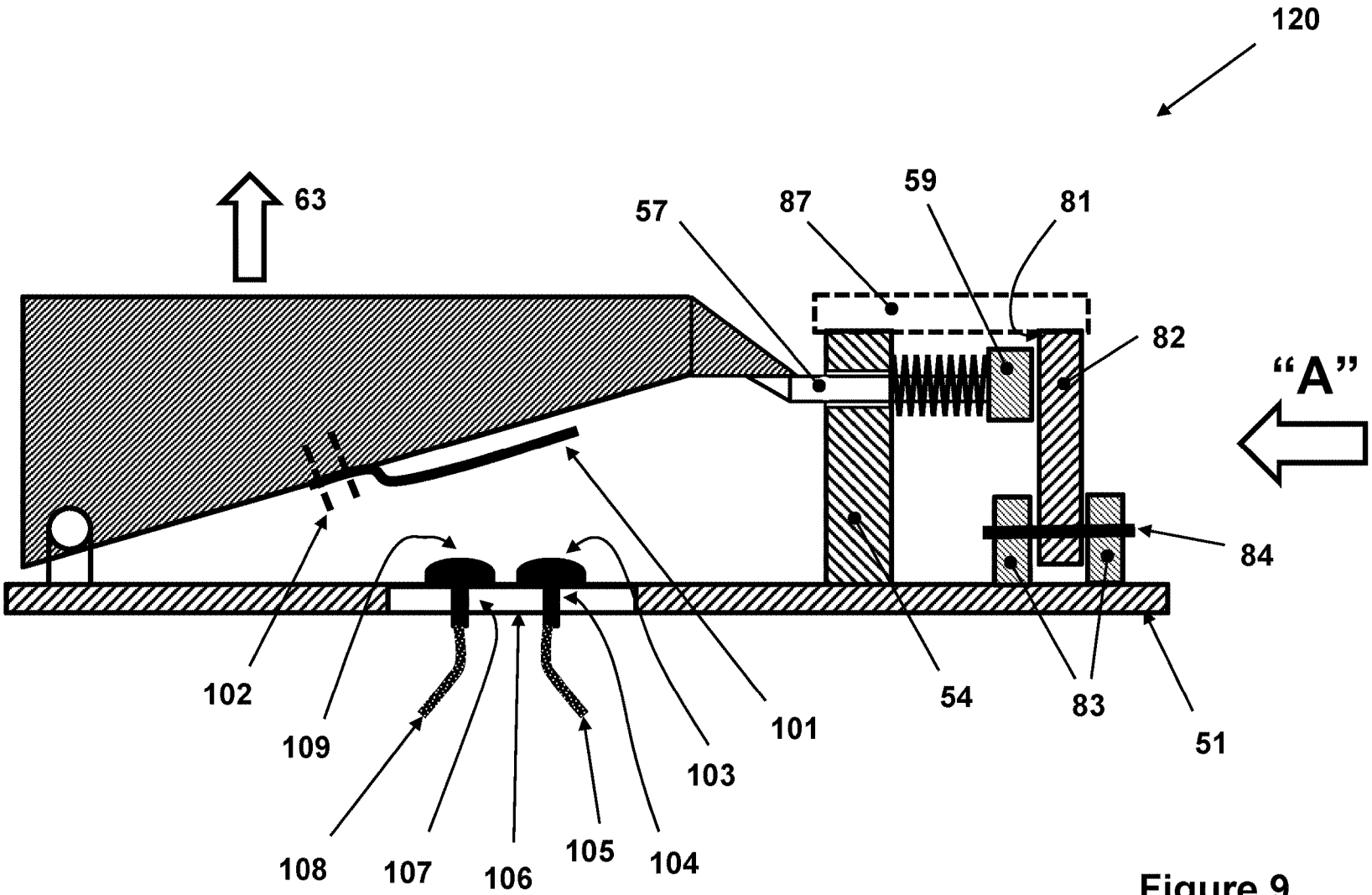
FIG. 9 illustrates a schematic of a cross section of a normally open g-switch embodiment corresponding to the third inertial igniter embodiment of FIG. 6A.
Figure 10:
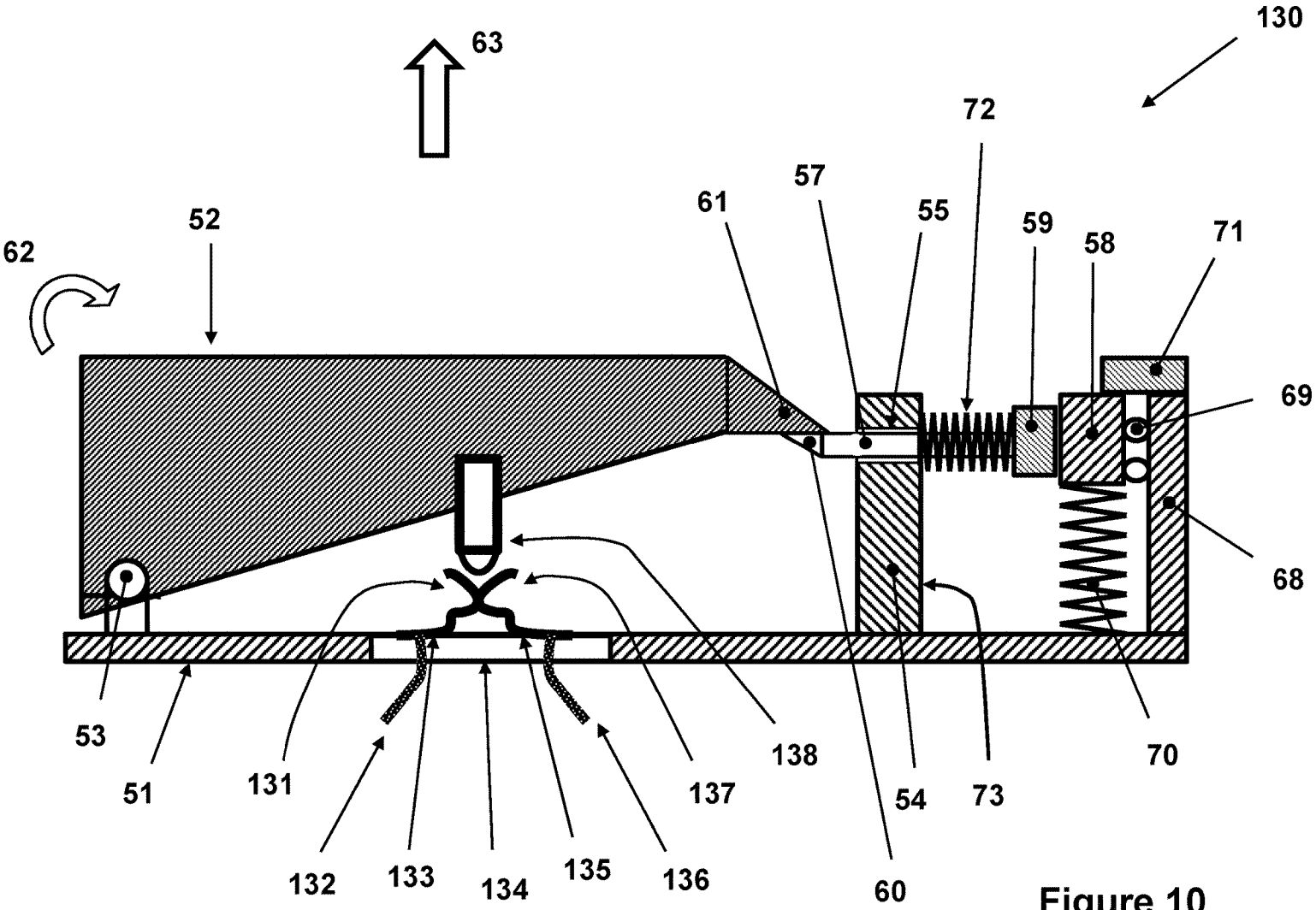
FIG. 10 illustrates a schematic of a cross section of a normally closed g-switch embodiment corresponding to the first inertial igniter embodiment of FIG. 4.
Figure 11:
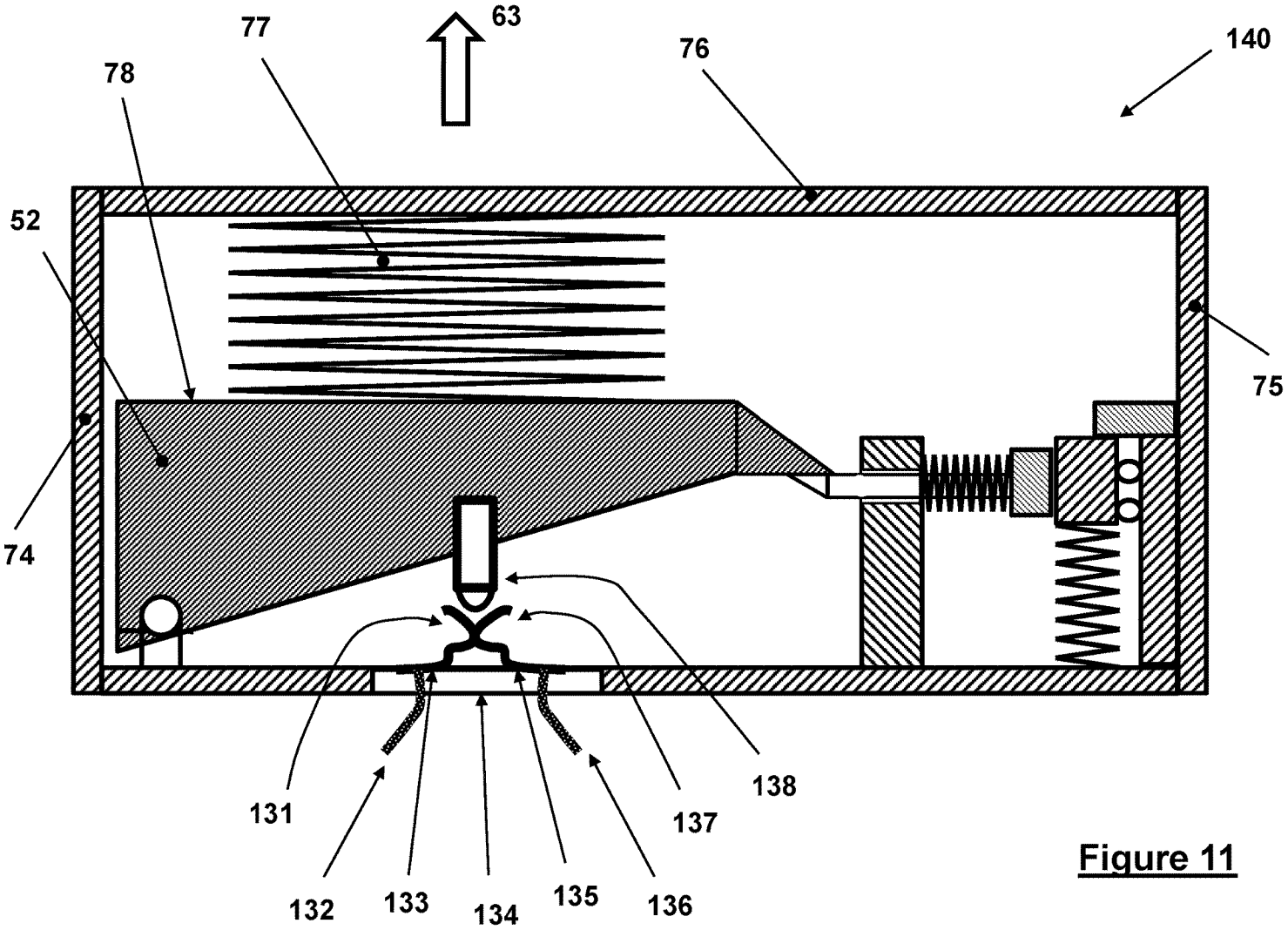
FIG. 11 illustrates a schematic of a cross section of a normally closed g-switch embodiment corresponding to the second inertial igniter embodiment of FIG. 5.
Figure 12:
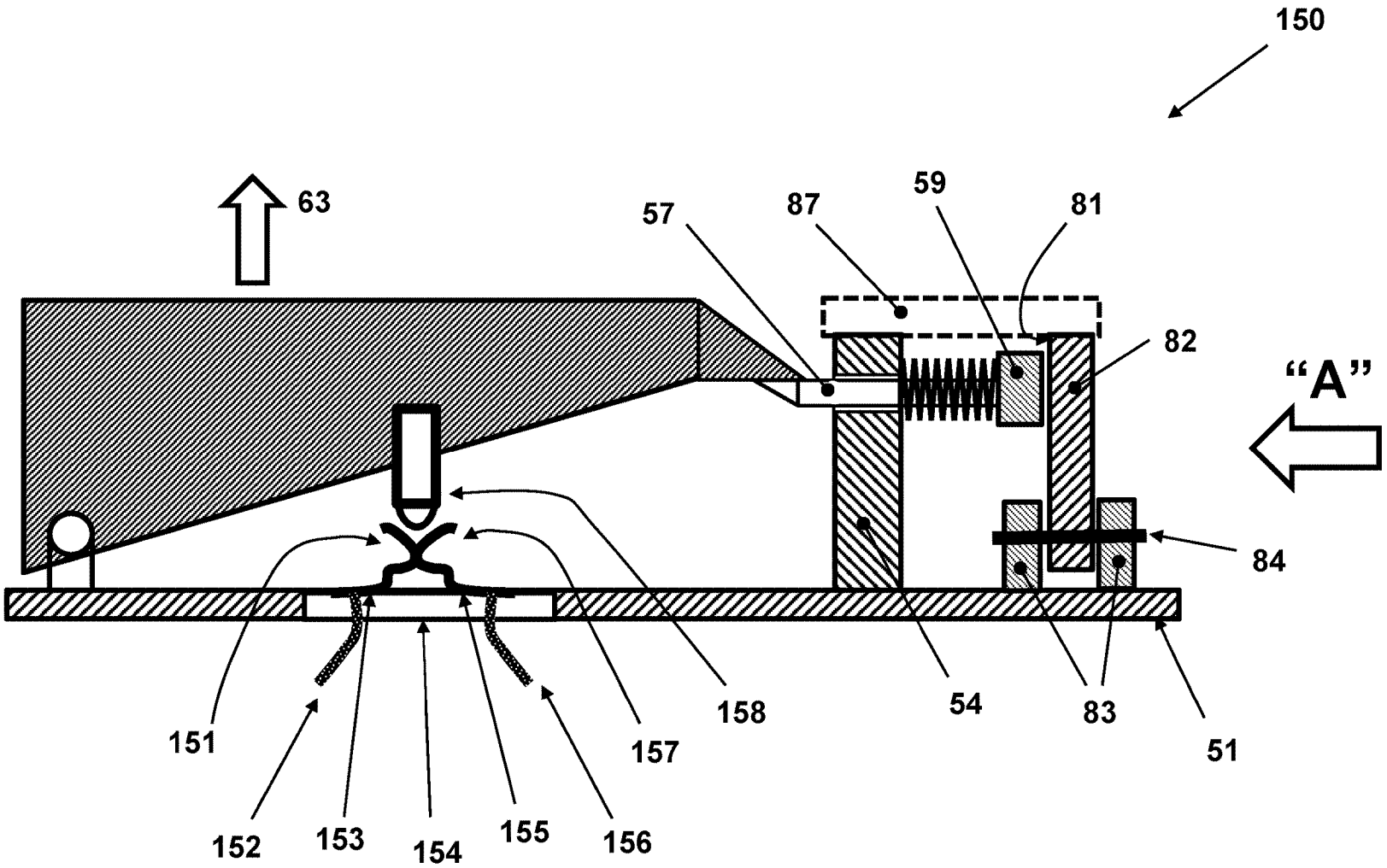
FIG. 12 illustrates a schematic of a cross section of a normally closed g-switch embodiment corresponding to the third inertial igniter embodiment of FIG. 6A.

Schematics of such G-switches are shown in FIGS. 7-12, where FIGS. 7-9 illustrate a normally open G-switch corresponding to the inertial igniter configurations of FIGS. 4, 5 and 6A, respectively, and FIGS. 10-12 illustrate a normally closed G-switch corresponding to the inertial igniter configurations of FIGS. 4, 5 and 6A, respectively.

Turning first to the G-switch 100 of FIG. 7, which is similar to the inertial igniter illustrated in FIG. 4, except that its pyrotechnic material and initiation elements (elements 64, 65 and 66 in FIG. 4) are removed. An element 106, which is constructed of an electrically non-conductive material is fixed to the base 51 of the device as shown in FIG. 7. The element 106 is provided with two electrically conductive elements 104, 107 with contact ends 103 and 109, respectively. Electrical wires 105 and 108 are in turn attached to the electrically conductive elements 104 and 107, respectively. As it was described for the embodiment 50 of FIG. 4, when the device is subjected to an all-fire acceleration in the direction of arrow 63, the striker mass 52 is release and rotated about the pivot 53 in the direction of arrow 62. The striker mass 52 is provided with a flexible strip of electrically conductive material 101 which is fixed to the bottom surface of the striker mass 52 (such as by being soldered or attached with fasteners 102). Therefore, as the striker mass 52 rotates towards the base 51 of the device, it would cause the flexible electrically conductive strip 101 to come into contact with the contact ends 103, 109, thereby causing the circuit through the wires 105 and 108 to close.

As discussed above with regard to FIG. 5, the g-switch of FIG. 7 can be provided with a biasing spring 77 to ensure that the flexible electrically conductive strip 101 stays in contact with the contact ends 103 and 109. Such an embodiment is shown in the g-switch 110 of FIG. 8.

As also discussed above with regard to FIGS. 6A and 6B, the sliding element 58 can be replaced by a rotating mechanism to reduce device complexity and the sliding friction forces. Such an embodiment is shown in the g-switch 120 of FIG. 9.

The G-switch 100 of FIG. 7 can also be readily modified to provide a "normally close" switching configuration. As an example, the contact components of the G-switch 130 may be modified to that shown in the schematic of FIG. 10. This embodiment 130 of the G-switch has all its other components being the same as those of the embodiment 100 of FIG. 10. The "normally closed" G-switch 130 is provided with two flexible contact elements 133 and 135, which are fixed to the electrically non-conductive member 134, which is fixed to the base 51 of the device 130. The flexible contact elements 133 and 135 are provided with contact points 131 and 137, which are normally in contact (such as by being biased towards each other), thereby causing the wires 132 and 136 that are attached to the contact elements 133 and 135 to close the electrical circuit to which they are connected. The striker mass 52 is provided with a non-conductive member 138 as shown in FIG. 10.

As was described for the embodiment 100 of FIG. 7, when the device is subjected to an all-fire acceleration in the direction of arrow 63, the striker mass 52 is release and rotated about the pivot 53 in the direction of arrow 62. As the non-conductive member 138 reaches the contact points 131 and 137, the force of the acceleration acting on the inertia of the striker mass 52 causes the member 138 to be inserted between the contact points 131 and 137, thereby rendering their contacts open and opening the aforementioned electrical circuit to which the wires 132 and 136 are connected.

As discussed above with regard to FIG. 5, the g-switch of FIG. 10 can be provided with a biasing spring 77 to ensure that the member 138 stays inserted between the contact points 131 and 137. Such an embodiment is shown in the g-switch 140 of FIG. 11.

As also discussed above with regard to FIGS. 6A and 6B, the sliding element 58 can be replaced by a rotating mechanism to reduce device complexity and the sliding friction forces. Such an embodiment is shown in the g-switch 150 of FIG. 12.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A device comprising:

an impact mass movably restrained relative to a base; and a release mechanism configured to be movable between a restrained position for preventing movement of the impact mass and a released position for permitting movement of the impact mass when the release mechanism is subjected to an acceleration greater than a predetermined magnitude and duration the release mechanism having a release mass movable when subjected to the acceleration;

wherein the release mechanism is configured such that a force is not applied from the impact mass to the release mass when the impact mass is subjected to the acceleration.

2. The device of claim 1, wherein the release mass is separated from the impact mass in a lateral direction relative to a direction of the acceleration.

3. The device of claim 1, wherein the impact mass is rotatably movable relative to the base.

4. The device of claim 1, further comprising a flame producing means for outputting a flame upon movement of the impact mass.

5. The device of claim 4, wherein the flame producing means comprises:

a first protrusion provided to protrude from a surface of the impact mass;

a second protrusion provided to protrude from the base, the second protrusion being positioned such that movement of the impact mass causes contact between the first and second protrusions;

a pyrotechnic provided proximate to one of the first and second protrusions such that the contact between the first and second protrusions ignites the pyrotechnic; and an opening in the base for outputting the flame from the base.

6. The device of claim 1, further comprising a biasing member for biasing the impact mass in a direction opposite to the direction of the acceleration.

7. The device of claim 1, further comprising a circuit for one of opening or closing an electrical circuit upon movement of the impact mass.

8. The device of claim 7, wherein the circuit comprises:

an electrically conductive member provided to a surface of the impact mass; and first and second electrical contacts, electrically isolated from each other, provided to the base, the first and second electrical contacts being positioned such that movement of the impact mass causes the electrically conductive member to contact and close the electrical circuit between the first and second electrical contacts.

9. The device of claim 7, wherein the circuit comprises:

an electrically non-conductive member provided to protrude from a surface of the impact mass; and first and second electrical contacts, electrically connected to each other, provided to the base, the first and second electrical contacts being biased in an electrically closed position and movable to an electrically open position, the first and second electrical contacts being positioned such that movement of the impact mass causes the electrically non-conductive member to move the first and second electrical contacts to the electrically open position.

10. The device of claim 1, wherein the release mechanism comprises:

a shaft having one end engaged with a portion of the impact mass and an other end engaged with the release mass, the shaft being movable to the released position upon movement of the release mass when the release mass is subjected to the acceleration; and a shaft biasing element for biasing the shaft into the released position when the release mass moves and is no longer engaged with the other end of the shaft.

11. The device of claim 10, further comprising a release mass biasing element for biasing the release mass into a position of engagement with the other end of the shaft.

12. The device of claim 10, wherein the release mass moves in translation.

13. The device of claim 10, wherein the release mass moves in rotation.

14. The device of claim 1, further comprising a housing including the base.

15. A method for moving an impact mass upon the impact mass experiencing an acceleration greater than a predetermined magnitude and duration, the method comprising:

movably restraining the impact mass relative to a base;

moving a release mechanism between a restrained position for preventing movement of the impact mass and a released position for permitting movement of the impact mass when the release mechanism is subjected to the acceleration;

configuring the release mechanism to have a release mass movable when subjected to the acceleration, wherein the release mechanism does not apply a force to the release mass when the impact mass is subjected to the acceleration.

16. The method of claim 15, further comprising separating the release mass from the impact mass in a lateral direction relative to a direction of the acceleration.

17. The method of claim 15, further comprising outputting a flame upon movement of the impact mass.

18. The method of claim 15, further comprising one of opening or closing an electrical circuit upon movement of the impact mass.

19. The method of claim 15, wherein the release mass moves in translation.

20. The method of claim 15, wherein the release mass moves in rotation.

* * * * *